US006772877B1

(12) United States Patent
Lam et al.

(10) Patent No.: US 6,772,877 B1
(45) Date of Patent: Aug. 10, 2004

(54) LIGHTWEIGHT COMPOSITE MONOPACK CONTAINER

(75) Inventors: Yuen H. Lam, Morris Plains, NJ (US); James F. Zoll, Flanders, NJ (US); Kwok L. Cheung, New York, NY (US); Yash Sinha, Trenton, NJ (US); Timothy Woo, Flushing, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 230 days.

(21) Appl. No.: 10/064,706

(22) Filed: Aug. 8, 2002

Related U.S. Application Data

(60) Provisional application No. 60/346,640, filed on Jan. 10, 2002.

(51) Int. Cl.[7] ..... F42B 39/00

(52) U.S. Cl. ..... 206/3; 206/521

(58) Field of Search ..... 206/3, 317, 521; 89/34, 36.01, 36.05; 215/43, 321; 226/324, 326

(56) References Cited

U.S. PATENT DOCUMENTS 2,308,480 A * 1/1943 Abbott et al. ..... 206/3
3,939,967 A * 2/1976 Tenney et al. ..... 206/3
4,159,764 A * 7/1979 Schinke ..... 206/3
4,279,339 A * 7/1981 Gotter ..... 206/3
4,356,913 A * 11/1982 Moraine ..... 206/3
4,733,773 A * 3/1988 LaBianca et al. ..... 206/3
4,762,222 A * 8/1988 Martin ..... 206/3
4,782,977 A * 11/1988 Watanabe et al. ..... 220/324
6,050,441 A * 4/2000 Kuo ..... 220/324
6,357,582 B1 * 3/2002 Fischer ..... 206/3

* cited by examiner

*Primary Examiner*—David T. Fidei
(74) *Attorney, Agent, or Firm*—Michael C. Sachs; John F. Moran

(57) ABSTRACT

A composite monopack container for mortar ammunition is lightweight, universally adaptable to all existing ammunition types, is capable of fully protecting ammunition without the need of a metal overpack, and is relatively inexpensive to produce, maintain and dispose. The container is also fully back-compatible enables a quicker ammunition re-supply and greater ammunition availability on the battlefield. The monopack container comprises a cap, a main body, a latch assembly that locks the cap and the main body, a pair of alignment features that mate with two corresponding alignment channels on the main body, and three stacking indices that prevent the container from rolling, and that make it stackable with other composite containers.

16 Claims, 4 Drawing Sheets

LIGHTWEIGHT COMPOSITE MONOPACK CONTAINER

This application claims the benefit of Provisional application Ser. No. 60/346,640, filed Jan. 10, 2002.

FEDERAL RESEARCH STATEMENT

The invention described herein may be manufactured and used by or for the Government of the United States for governmental purposes without the payment of any royalties thereon.

BACKGROUND OF INVENTION

1. Field of the Invention

The invention described herein relates to the field of military ordnance. In particular it relates to high caliber ammunition fired from weapons in the arsenal of the United States Army, and more specifically to ammunition containers that protect the rounds fired from these weapons. The ammunition containers described herein offer distinct advantages over those that preceded them. The containers provide superior protection from shock, vibration, exposure to the elements and address important concerns related to weight, operational effectiveness, cost, and environmental impact. While specifically developed for mortar ammunition the technology of this invention is readily adapted tank ammunition, grenades, and other ammunition families that utilize the fiber container packaging technology.

2. Background of the Invention

Ordnance used on the modern battlefield and in training exercises by the United States Army must be protected from the effects of vibration, shock and exposure to the elements. Exemplary cases are relatively lightweight, mobile weapons such as the Army's 60 mm, 81 mm and 120 mm mortars. The inherent portability, flexibility and ubiquity of these weapons dictate that they and the ammunition they fire can and will be exposed to a very wide range of non-ideal conditions.

In particular, these weapons and their ammunition are expected and, indeed, required to perform as designed in conditions that include extreme heat and cold, as well as wet and dusty environs. In addition, ammunition for these mortars is expected to survive high g-loadings such as those that might be experienced when being transported by tracked or wheeled vehicles, carried by soldiers or even delivered by fixed- or rotary-wing aircraft or even by parachute. As such, whose rounds are currently packed in pairs in a metal/fiber packing system.

Recent emphasis on rapid deployment and the requirement for heretofore unimaginable mobility and unprecedented firepower, as exemplified by the US Army's new Lightweight Brigade Combat Team (BCT), gives all new importance to minimizing the weight and volume associated with packing materials while maintaining the protection required by these highly explosive rounds. In addition, cost and environmental concerns can no longer be ignored and, therefore, must be addressed in an effective manner. These requirements place added restrictions on construction materials and techniques and require that the containers be re-usable and/or recyclable.

The current metal/fiber container packing system for 120 mm mortar ammunition was designed/developed by contractors in the early 1990s. In its current embodiment, the packaging system consists of two PA153 fiber containers inside a PA154 metal container. Two loaded PA153 fiber containers are packaged inside the PA154 metal container to achieve the long term protection to the ammunition against various rough handling environments while still fitting inside the vehicle for operations.

In a typical battlefield or training scenario, the PA153 fiber containers are removed from the PA154 metal container at the point of re-supply. This is a time-consuming exercise, placing an added burden on the soldiers, could leave the mortar cartridges relatively unprotected, and could leave the discarded metal containers subject to loss and/or damage. The final condition is an important consideration when unexpended rounds need to be re-stored.

The existing metal/fiber container system with 2 rounds of ammunition has a gross weight of 101 lb. Because it exceeds the 90-pound maximum lift of a single package by a single soldier, as mandated in Operations Requirement Documentation, it must be handled by two persons.

In order to access the ammunition, the soldiers must first open the metal container, pull out the fiber containers, open the tape-seals of fiber containers and retrieve the ammunition. This is obviously is a very time-consuming process that affects combat readiness. In addition, the tight-fitted fiber containers are difficult to be removed from the metal container under non-ideal conditions such as cold weather where soldiers are wearing heavy gloves.

During military operations, soldiers normally discard the metal containers at the ammunition supply point and only the loaded fiber containers are placed into the storage racks of a mortar carrier. Since it is the metal container that provides most of the environmental protection to the ammunition inside, the ammunition sitting in the racks inside the vehicle can be adversely affected by moisture and rough handling. This can decrease the overall useful life of the ammunition especially if the ammunition is no expended immediately.

Furthermore, metal containers are also often lost or damaged after vehicle uploading and the two container approach to packaging becomes a burden on the soldier should the ammunition need to be repackaged. This is especially important in training situations where ammunition is often re-loaded and returned to an ammunition storage facility for future use. In addition, it may be observed that the fiber containers are not readily recyclable nor re-usable, resulting in higher production costs and environmental impact.

Thus, there is a great and still unsatisfied need for a solution to the problem of producing an efficacious, cost-effective, lightweight container for mortar rounds.

SUMMARY OF INVENTION

The composite monopack container of the present invention represents a new generation of packing container for mortar ammunition, and addresses the shortcomings of the existing packaging systems. In particular, the container is lightweight, universally adaptable to all existing ammunition types, is capable of fully protecting ammunition without the need of a metal overpack, and is relatively inexpensive to produce, maintain and dispose.

In addition, the container is easy to use and fully back-compatible, that it is compatible with existing ammunition racks, etc., within the inventory. Moreover, the new implementation features mean quicker ammunition re-supply and greater ammunition availability on the battlefield.

The lightweight monopack container is made from lightweight thermoset, flame-retardant composite materials. This composite compound material comprises Vinyl Ester resin and 56% (by weight) fiber glass designed for compression molding of components requiring high structural strength. These elements are subjected to a pressure of 1,500 pounds per square inch (minimum) at 290° F. for 5–10 minutes during the molding process. Primary features of the container are formed during the molding process, reducing post-processing time and minimizing production costs.

The monopack container comprises a cap and body assembly sufficiently rugged and impervious to environmental factors to eliminate the need for secondary containment. Unlike its predecessor, the monopack container provides full environmental protection for the ammunition from adverse battlefield conditions at all times until the actual point-of-use and, thus, increases the service life of ammunition and greatly simplified re-packaging operations in cases when ammunition is unpacked but not expended.

Further, it is anticipated that the composite monopack container will provide improved Insensitive Munitions (IM) response compared to the current metal/fiber container packing system. In particular, the composite resin will burn very slowly and evaporate at the elevated temperature (carrying away the heat of evaporation), thus preventing a high pressure built-up inside the container. In addition, the composite container contains minimal amount of metal materials, limited to a small latching system and several tie down rivets, as compared to the current heavy duty PA154 metal container. Therefore, no significant amounts of fragmentations are expected.

Weighing about 7.5 lbs, one embodiment of the monopack container is designed to hold a single cartridge, and be carried or handled by a single soldier. Advantageously, a collapsible type handle is attached to the container exterior surface of the monopack container to facilitate hand-carry of the containerized round for a short distance maneuver. It incorporates alignment features to assure the container cap matches the body assembly in correct orientation for proper closure.

The monopack container has a built-in stacking feature with two exterior octagonal shapes indices located close to each end of the container. The container is closed and sealed by locking the latching system, a mechanism that relies on a heavy duty low profile draw-latch. The seal/latch-system lends itself to operation under extreme environmental conditions, such as intensely cold or foul weather, or NBC (Nuclear, biological, chemical) conditions on the battlefield in which normal gear is augmented by gloves and other special protective equipment that restrict movement and dexterity.

A rubber gasket located inside the cap is compressed onto the top edge of the container body and, hence, provides sealing capability up to a maximum of three pounds-per-square-inch differential pressure while the container is closed and sealed. Thus, the containerized round will remain dry and fully protected while submerged in as much as, for example, 7 feet of water. These sealing features are superior in both ease-of-use and efficacy when compared to the current tape-seal system.

In addition to being waterproof, the container is water-vapor-proof and is able to provide full protection to the ammunition for storage in an uncontrolled outdoor environment for a minimum of one year and in an indoor controlled environment for a minimum of 20 years. The container has exceptional impact strength allowing it to survive under all kinds of battlefield environments and temperatures ranging from approximately −65° F. to 160° F.

Sub-packing components specially designed to provide a tight package to the interior of the container along with the cartridge assure a quality pack at the loading facilities, to insure optimal protection to the ammunition being transported. These sub-packing components include a fuze support and other cushioning materials that allow the monopack container to be readily adapted to the full array of mortar ammunition, such as for example: high explosive, illuminating, infrared illuminating, and smoke cartridges.

The advantages afforded by the reduced weight, volume, packing material are not limited to the point-of-use. These reductions translate into more munitions in a given volume, more munitions carried and delivered in combat and to obvious general improvements in logistics operation efficiency and reduction in production and shipping costs.

The use of a single layer container packaging system also decreases the burden on soldiers by eliminating the need to remove outer containers prior to uploading to vehicles and decreases the time it takes to re-supply a mortar carrier with ammunition. The quick re-supply of ammunition on the battlefield is literally a matter of life-and-death, and therefore this may be a very significant benefit of the present container system.

The monopack container is designed to be both reusable and recyclable. It, therefore, reduces the environmental burden and decreases disposal costs. The container also significantly saves money during the LAP (loading, assembling and packing) process as the single-layer packaging system simplifies the packing operation and significantly improves the logistics operations by reducing weight and volume and packaging. A security wire seal is used to complete the packing operation makes the unit tamper-proof.

Back-compatibility is yet another feature of the monopack container. The monopack container design is able to work in existing vehicle racks and also can function side-by-side with the existing fiber containers. There will be no need to repackage existing inventory of ammunition.

The composite monopack container represents a new generation of packing container for the 120 mm mortar ammunition. It is readily observable that the monopack container of this invention addresses the needs of the US Army of providing superior protection for mortar round, while reducing production and disposal costs, providing and promoting ease-of-use in the field, and providing substantial weight reduction over their predecessors. While the present invention is described here in connection for 120 mm rounds, the technology is readily extended to rounds used in 60 mm and 81 mm mortars, and also to tank and howitzer ammunition, hand grenades, and other explosive ordnance that requires packaging for safe transportation and currently rely on fiber/metal container packaging technology.

BRIEF DESCRIPTION OF DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and of the purpose of explanation.

DETAILED DESCRIPTION

Figure 1:
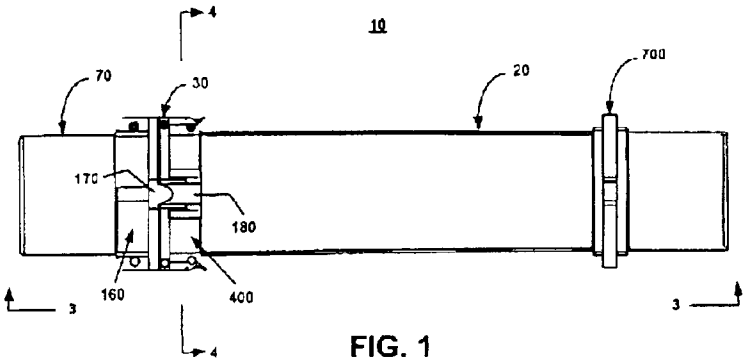
FIG. 1 is a side overall assembly view of a monopack container for use as a primary packaging of a mortar round according to the present invention.

FIG. 1 depicts a side view of the overall assembly of a monopack container 10 of the present invention. The container 10 is generally comprised of a mated cap 70 and a main body 20. The cap 70 and main body 20 can be formed, for example, in a compression molding operation using a fire-retardant thermoset vinyl ester composite molding compound. The primary features of the cap 70 and the main body 20 are formed during the molding process, reducing post-processing time and minimizing production costs. The resulting components are structurally sound, fire-retardant, waterproof and water-vapor proof. Thus, a mortar round sealed in the container 10 is fully protected from external elements from −65° F. to 160° F. without the need for secondary containment. The cap 70 and main body 20 have a generally cylindrical shape, augmented by a plurality of stacking indices 160, 400, 700 (FIG. 2), as they will be described later in more detail, that enable a plurality of containers 10 to be stacked efficiently without rolling.

Figure 2:
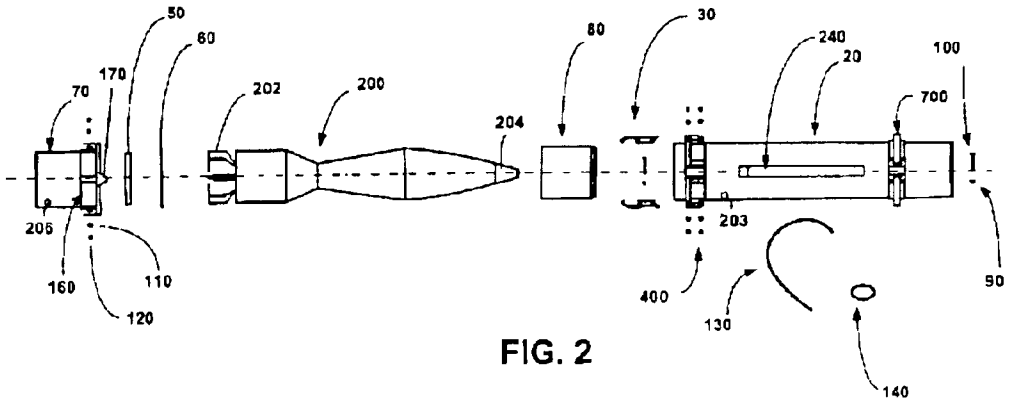
FIG. 2 is an exploded view of the monopack container of FIG. 1 showing its constituent components along with a representative mortar round.

FIG. 2 provides an exploded view of the components forming the monopack container 10. A single mortar round 200 to be housed in the container 10, is also depicted for completeness purpose. In addition to the cap 70 and main body 20 shown in FIG. 1, the monopack container 10 includes a latch assembly 30, a collapsible handle 240, a fin support 50, a gasket 60, a mortar support 80, a nut 90, and a bolt 100 for the main body 20, along with a bolt 110 and nut 120 for the cap 70.

In addition, a tamper wire 130 and wire lock 140 augment the sealing security of the assembly by providing an anti-tamper feature. Nut 110 and bolt 120, located on the cap 70, form the keepers for the latch assembly 30. Bolt 90 and nut 100, located on the container body, secure the base of the latching system to the main body 20. A standard UgotgotS Army anti-tamper wire 130 is inserted through a small hole 203 formed on the container main body 20, and a matching small hole 206 formed in the cap 70 to form a security seal. Wire 130 is locked by wire lock 140 preventing accidental opening and providing evidence of prior entry to the monopack container 10.

The latch assembly 30 is an important constituent of the monopack container 10. It provides the clamping force needed to seal the gasket 60 against the top edge of the container body 20. The rubber gasket is located inside the cap 70. The latch assembly 30 is based on a heavy duty low profile design that lends itself to operation under extreme environmental conditions, such as intensely cold or foul weather, or nuclear, biological, or chemical conditions on the battlefield in which normal gear is augmented by gloves and other special protective equipment that restrict movement and dexterity. When the latch assembly 30 is unhinged and the cap 70 is removed, the fins 202 of the mortar round 200 are exposed and readily grasped by the soldier allowing the round to be rapidly removed from the main body 20.

A pair of V-shaped alignment features 170, one of which is shown in FIG. 2, are oppositely, diametrically formed on the open end of the cap 70, and mate with two corresponding alignment channels 180 (FIGS. 1 and 6) on the open end of the main body 20. These alignment features 170 allow the cap 70 to be easily and accurately placed on the main body 20, assuring precise alignment of the sealing gasket 60, and accurate alignment of the latch assembly 30.

A collapsible handle 240 is located on the axial center of the main body 20. The handle 240 allows the monopack container 10 to be carried easily by a single soldier. The low profile afforded by the collapsible handle 240 permits easy stacking of the monopack container 10 while its axial location results in a well-balanced assembly.

During the packing operation, sub-packing components, such as mortar support 80 and fin support 50 are installed according to the type of mortar round to be installed and, thus, provide necessary support and cushioning for the key elements of the round. In particular, mortar support 80 and fin support 50 are designed to fit the particular type of round 200 that is to be protected, be it high explosive, illuminating, infrared illuminating or smoke cartridges.

Figure 3:
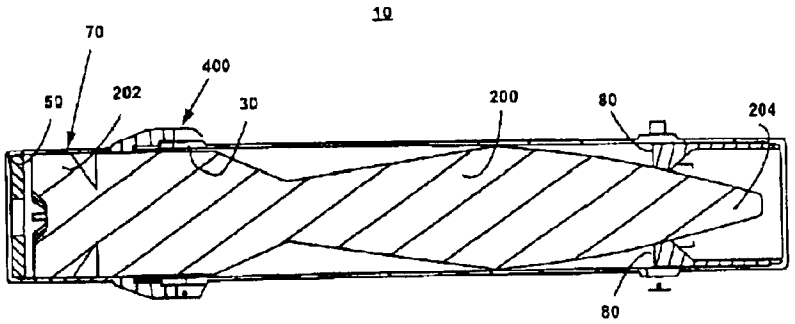
FIG. 3 is a detailed lateral cross-sectional view of the monopack container of FIG. 1, taken along line 3—3, with emphasis on the use of specialized sub-packing components to achieve support and protection of a particular ammunition type.

FIG. 3 provides a detailed, side cross-sectional view of the monopack container 10 of FIGS. 1 and 2, with emphasis on the use of specialized sub-packing components used to achieve support and protection of the mortar round 200. The mortar support (or fuze support) 80 protects the fuze/payload/warhead 204 of the round, providing cushioning from exterior forces. This support 80 is customized to the specific type of round 200 that is packaged. A preferred composition of the support 80 is High Density Polyethylene (HDPE). Fin support 50 protects the fins 202 of the mortar round 200 from damage and distortion that could adversely affect the flight path of the round. Fin support 50 can be made out of fiberboard material that is widely used in housing construction with a density of 34–40 lb per cubic ft.

Figure 4:
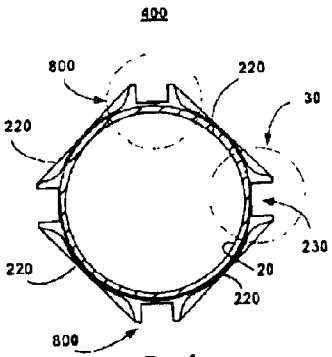
FIG. 4 is a detailed, cross-sectional, end-view of the monopack container of FIG. 1, taken along line 4—4, illustrating a proximal body stacking index.

FIG. 4 is an end view of the cross section of the monopack container 10 of FIG. 1. This view emphasizes the general cylindrical shape of the monopack container 10. A proximal body stacking index 400 is formed of a plurality, i.e., 4, of stacking ribs 220 that are integrated at discrete axial locations along the cylindrical composite wall of the body 20, making the monopack container (10) design conducive to stacking ammunition while maintaining compatibility with existing ammunition racks. The stacking ribs 220, also referred to herein as octagonal features, prevent the container 10, and thus the round 200, from rolling. The stacking ribs 220 are generally similar in shape and composition, and are symmetrically disposed relative to the body 20.

With reference to FIG. 2, the container 10 further includes a cap staking index 160 and a distal body stacking index 700 that are generally similar in function to proximal body stacking index 400, but they could vary in design, such that they could have a different number of stacking ribs.

Figure 5:
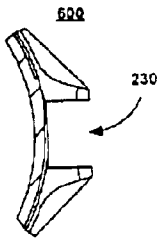
FIG. 5 is an enlarged, detailed view of a latch sub-assembly of the monopack container of FIG. 4.

In the exemplary embodiment of FIGS. 4 and 5, the latch assembly 30 is formed of two generally similar latch sub-assemblies 600 that are symmetrically disposed on the outer perimeter of the body 20. With particular reference to FIG. 5, one latch channel 230 is formed for each of the latch sub-assemblies 600, and is designed to protect the latch assembly 30 from damage if the container 10 is accidentally dropped. The wall height of the channel 230 is slightly taller than the height of the latch that resides in the channel 230 so as to absorb impacts during testing and field use and, therefore, to protect the latch assembly 30 from damage.

Figure 6:
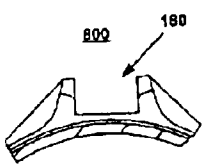
FIG. 6 is an enlarged, detailed view of an alignment assembly of the monopack container of FIG. 4.

FIG. 6 is an enlarged, detailed view of one of the two alignment assemblies 800 of the monopack container 10 of FIG. 4. As shown in FIG. 4, the two alignment assemblies 800 are oppositely and diametrically disposed relative to the body 20, and are separated from the latch sub-assemblies 600 by approximately 90 degrees. Each alignment assembly 800 includes an alignment channel 180, which, as described earlier, accepts the V-shaped alignment feature 170.

It should be understood that the foregoing description are not intended to be limiting, but are only exemplary of the inventive features of the present invention. Other modifications or embodiments may be conceived without departing from the scope of the present invention.

What is claimed is:

1. A container for housing and protecting an ammunition, comprising:

a cap;

a main body;

a latch assembly disposed in part on the cap and in part on the main body to lock the cap and the main body in position;

a pair of alignment features are generally oppositely formed on one end of the cap, and mate with two corresponding alignment channels on a proximal end of the main body, wherein the pair of alignment features allow the cap to be accurately positioned relative to the main body;

a proximal body stacking index disposed on the proximal end of the main body;

a distal body stacking index disposed at a distal end of the main body;

a cap staking index disposed at the end of the cap; and wherein the proximal body stacking index, the distal body stacking index, and the cap stacking index prevent the container from rolling.

2. The container of claim 1, wherein the proximal body stacking index comprises a plurality of stacking ribs.

3. The container of claim 2, wherein the proximal body stacking index comprises four stacking ribs that are disposed around the perimeter of the main body, allowing the container to be stackable.

4. The container of claim 2, wherein the main body is generally cylindrically shaped.

5. The container of claim 4, further comprising a collapsible handle secured along the main body.

6. The container of claim 2, wherein the ammunition comprises a plurality of fins; and further comprising a fin support that supports the plurality of fins.

7. The container of claim 6, further comprising a gasket; and wherein the latch assembly provides a clamping force to seal the gasket against the proximal end of the container body.

8. The container of claim 7, wherein the rubber gasket is located inside the cap.

9. The container of claim 7, further comprising a mortar support disposed inside the main body to support the ammunition.

10. The container of claim 1, wherein the main body and the cap are made of lightweight, thermoset, flame-retardant composite material.

11. The container of claim 10, wherein the composite material is comprised of vinyl ester resin and fiber glass material.

12. The container of claim 1, further comprising a tamper wire and a wire lock to prevent accidental opening of the container.

13. The container of claim 1, wherein the main body comprises two generally similar latch channels disposed at the proximal end of the main body; and wherein each latch channel defines a latch wall.

14. The container of claim 13, wherein the latch assembly engages the latch channels when the main body and the cap are secured together.

15. The container of claim 14, wherein the latch wall has a higher profile than the latch assembly to prevent accidental disengagement of the latch assembly.

16. The container of claim 15, wherein the pair of alignment channels are alternatively disposed relative to the latch channels.

* * * * *